US008420011B2

(12) United States Patent
Morishita et al.

(10) Patent No.: US 8,420,011 B2
(45) Date of Patent: Apr. 16, 2013

(54) ALUMINUM ALLOY PLATE AND PROCESS FOR PRODUCING THE SAME

(75) Inventors: Makoto Morishita, Moka (JP); Katsushi Matsumoto, Kobe (JP); Shigenobu Yasunaga, Moka (JP); Takashi Inaba, Moka (JP)

(73) Assignee: Kobe Steel, Ltd., Kobe-shi (JP)

( * ) Notice: Subject to any disclaimer, the term of this patent is extended or adjusted under 35 U.S.C. 154(b) by 1014 days.

(21) Appl. No.: 11/814,124

(22) PCT Filed: Jan. 13, 2006

(86) PCT No.: PCT/JP2006/300380

§ 371 (c)(1), (2), (4) Date: Feb. 14, 2008

(87) PCT Pub. No.: WO2006/077779

PCT Pub. Date: Jul. 27, 2006

(65) Prior Publication Data

US 2009/0071576 A1 Mar. 19, 2009

(30) Foreign Application Priority Data

Jan. 19, 2005 (JP) ..... 2005-011812
Jan. 25, 2005 (JP) ..... 2005-017236

(51) Int. Cl.
*C22C 21/06* (2006.01)
*C22F 1/04* (2006.01)

(52) U.S. Cl.
USPC ..... 420/542; 420/547; 420/548; 148/551; 148/440; 148/439

(58) Field of Classification Search ..... 148/551, 148/440, 439
See application file for complete search history.

(56) References Cited

U.S. PATENT DOCUMENTS 4,626,294 A 12/1986 Sanders, Jr.

FOREIGN PATENT DOCUMENTS

| | | | |
|---|---|---|---|
| EP | 0 610 006 | A1 | 8/1994 |
| EP | 0 846 781 | A1 | 6/1998 |
| EP | 1 842 935 | A1 | 10/2007 |
| JP | 1 202345 | | 8/1989 |
| JP | 7 252571 | | 10/1995 |
| JP | 8 165538 | | 6/1996 |
| JP | 10-259441 | | 9/1998 |
| JP | 2001-032031 | | 2/2001 |
| RU | 2 111 826 | C1 | 5/1998 |
| WO | 03/027345 | A1 | 4/2003 |

OTHER PUBLICATIONS

Machine translation of JP 07252571.*
Supplementary European Search Report issued Jun. 6, 2011, in European Patent Application No. 06711665.7 filed Jan. 13, 2006.

* cited by examiner

*Primary Examiner* — Emily Le
*Assistant Examiner* — Rebecca Lee
(74) *Attorney, Agent, or Firm* — Oblon, Spivak, McClelland, Maier & Neustadt, L.L.P.

(57) ABSTRACT

The present invention provides an Al—Mg series alloy sheet of high-Mg with improved press formability and homogeneity which can be applied to automobile outer panels and inner panels. This is an Al—Mg series aluminum alloy sheet having 0.5 to 3 mm in thickness cast by twin-roll continuous casting and cold rolled, comprising over 8% but not more than 14% Mg, 1.0% or less Fe, and 0.5% or less Si with the remainder being Al and unavoidable impurities wherein the mean conductivity of the aluminum alloy sheet is in the range of at least 20 IACS % but less than 26 IACS %, the strength-ductility balance (tensile strength×total elongation) as a material property of the aluminum alloy sheet is 11000 (MPa %) or more, and the homogeneity and press formability of the sheet have been improved.

13 Claims, No Drawings

ALUMINUM ALLOY PLATE AND PROCESS FOR PRODUCING THE SAME

TECHNICAL FIELD

The present invention provides an Al—Mg series aluminum alloy sheet with a high-Mg content obtained by continuous casting, having an excellent strength-ductility balance and excellent formability, and providing a method for manufacturing the same.

BACKGROUND ART

In recent years, efforts have been made in the field of automotive and other transport vehicle bodies to improve fuel consumption by lowering weight in order to deal with environmental problems due to exhaust gas or so. As a result lighter Al alloy materials such as rolled sheets and extruded section materials have come to be used increasingly in automobile bodies in place of conventional steel materials.

Of these, use of Al—Mg series aluminum alloy or JIS 5000 series (hereunder called simply 5000 series or Al—Mg series) aluminum alloy sheets or Al—Mg—Si series aluminum alloy or JIS 6000 series aluminum alloy sheets has been studied for outer panels, inner panels and so on of automobile body panels (panes structures) such as automobile hoods, fenders, doors, roofs and trunk lids.

The aforementioned aluminum (sometimes called Al below) alloy sheets for automobile body panels need to have high press formability. The Al—Mg series Al alloys, which have an excellent strength-ductility balance, are the best of the aforementioned Al alloys in terms of press formability.

Consequently, research has already been done into optimizing the manufacturing conditions and the components of such Al—Mg series Al alloy sheets. JIS A 5052, 5182 and the like are typical alloy compositions of Al—Mg series Al alloys. However, even such Al—Mg series Al alloys are less ductile and less formable than cold-rolled steel sheets.

However, when the Mg content of an Al—Mg series Al alloy is increased over 8% to make a high-Mg alloy, the strength-ductility balance improves. However, such an Al—Mg series alloy of high-Mg is difficult to manufacture industrially by normal manufacturing methods such as die-casting in which the cast ingot is hot rolled after being soaked. This is because the Mg segregates in the ingot during casting, and normal hot rolling produces an Al—Mg series alloy with much lower ductility, increasing the likelihood of cracks.

It is also difficult to hot roll an Al—Mg series alloy of high-Mg at low temperatures in order to avoid the temperature range at which the aforementioned cracking occurs. This is because the deformation resistance of the material of an Al—Mg series alloy material of high-Mg is much higher at such low temperatures, and there are severe limits on the size of a product that can be manufactured with current rolling machines.

Methods such as adding a third element such as Fe, Si or the like have also been proposed for increasing the allowable Mg content of Al—Mg series alloy of high-Mg. However, as the content of such third elements rises, coarse intermetallic compounds are more likely to forms reducing the ductility of the aluminum alloy sheet. Consequently, there is a limit on increasing the allowable Mg content, and it is difficult to include Mg in amounts over 8%.

Therefore, there have already been a variety of proposals for manufacturing Al—Mg series alloy sheets of high-Mg by continuous casting methods such as twin-rolling. In twin-roll continuous castings an aluminum alloy melt is injected from a refractory supply nozzle and solidified between a rotating pair of water-cooled copper casting molds (twin rolls), and then reduced and rapidly cooled between the twin rolls immediately after the aforementioned solidification to produce an aluminum alloy thin sheet. Examples of such twin-roll continuous casting methods include Hunter's methods and the 3C method.

The cooling rate in twin-roll continuous casting is 1-3 digits larger than that of conventional DC casting or continuous belt casting Consequently, the resulting aluminum alloy sheet has an extremely fire structure, and excellent workability including press formability A relatively thin aluminum alloy sheet with a thickness of 1 to 13 mm can also be obtained by casting. As a results steps such as hot rough rolling and hot finish rolling which are required for conventional DC ingots (thickness 200 to 600 mm) can be omitted. Homogenization of the ingot can also be omitted in some cases.

Examples have already been proposed in which the structure of such an Al—Mg series alloy sheet of high-Mg manufactured by twin-roll continuous casting is specified with the aim of improving formability. For example, an automobile aluminum alloy sheet with excellent mechanical properties has been proposed in which the mean size of the Al—Mg series intermetallic compounds is 10 μm or less in an Al—Mg series alloy sheet with a high-Mg content of 6 to 10% (Patent document 1 below). An aluminum alloy sheet for automobile body use has also been proposed in which the mean size of the crystalline grains is restricted to 10 to 70 μm and the number of Al—Mg series intermetallic compounds having a size of 10 μm or more is restricted to 300/mm$^2$ or less (Patent document 2 below).

Patent document 1: Japanese Patent Application Laid-open No. H7-252571 (Claims, pages 1-2)

Patent document 2: Japanese Patent Application Laid-open No. H8-165538 (Claims, pages 1-2)

DISCLOSURE OF INVENTIONS

Problems to be Solved by the Invention

As shown in the above patent documents 1, 2, the Al—Mg series intermetallic compounds which crystallize during casting have a tendency to become a starting point for breakdown during press forming. Consequently, an effective means of improving the press formability of an Al—Mg series alloy sheet of high-Mg manufactured by twin-roll continuous casting is to restrict the size of these Al—Mg series intermetallic compounds (also called Al—Mg series compounds) or restrict the number of large compounds as explained in the aforementioned patent applications. Minimizing the size of the crystalline grains in the sheet is also an effective means of improving press formability.

However, application to automobile panels cannot be easily achieved merely by minimizing the size of the Al—Mg series intermetallic compounds or reducing the number of large compounds, even if the size of the crystalline grains is also minimized. Of the automobile panels, application to the aforementioned outer panels and inner panels of the automobile body panels is especially difficult. This is because automobile design trends are tending to make these outer and inner panels larger and more complex in shape, which makes them more difficult to form.

Moreover, when the Mg content is high, for example 10% or more, the higher the Mg content, the larger the variation in material quality of the Al—Mg series alloy sheet. This is because as explained below, in conventional twin-roll continuous casting methods a lubricant is applied to the rolls before casting, with the result that the solidification rate may be insufficient depending on the location on the sheet, while macro- and micro-segregation is also greater at higher Mg contents. Consequently, in conventional twin-roll continuous casting methods, the higher the Mg content, the more difficult it is to keep the strength-ductility balance uniform within the same Al—Mg series alloy sheet.

Consequently, it is insufficient to simply minimize the size of the crystalline grains while minimizing the size of the Al—Mg series intermetallic compounds or reducing the number of large compounds as in the above patent documents 1, 2 in order to improve the press formability of the aforementioned actual outer and inner panels formed from Al—Mg series alloy sheets of high-Mg manufactured by twin-roll continuous casting.

In order to resolve these problems, it is a first object of the present invention to provide a Al—Mg series aluminum alloy sheet of high-Mg obtained by continuous casting which has an excellent strength-ductility balance, excellent formability and homogeneity within the sheet.

Even if the Al—Mg series intermetallic compounds which crystallize during castling are controlled by raising the cooling rate (casting rate) in twin-roll continuous casting, subsequent processes in which a sheet ingot or thin sheet is heated to high temperatures of 400° C. or more or a heated sheet ingot or thin sheet is cooled may be selectively included as part of the process design, including not only cooling to room temperature after continuous casting but also homogenizing heat treatment before cold rolling, intermediate annealing during cold rolling and solution treatment after cold rolling. Al—Mg series intermetallic compounds are likely to occur during these heat history processes.

Consequently, even if occurrence of Al—Mg series intermetallic compounds is controlled in the twin-roll continuous casting process, the press formability of an Al—Mg series alloy sheet of high-Mg as a final product cannot be improved unless Al—Mg series intermetallic compounds occurring during the aforementioned subsequent heat history processes are also controlled.

In order to resolve such problems, it is a second object of the present invention to provide a method for manufacturing an Al—Mg series alloy sheet of high-Ma in which press formability is improved by controlling the Al—Mg series intermetallic compounds which occur in the heat history processes following twin-roll continuous casting.

Means to Solve the Problems

To achieve the aforementioned first object, the aluminum alloy sheet of the present invention is in essence an Al—Mg series aluminum alloy sheet having a thickness of 0.5 to 3 mm which has been cast by twin-roll continuous casting and cold rolled, comprising over 8% and not more than 14% Mg, 1.0% or less Fe and 0.5% or less Si by mass percentage, wherein the mean conductivity of the aluminum alloy sheet is in the range of at least 20 IACS % but less than 26 IACS %, and the strength-ductility balance (tensile strength×total elongation) as a material property of the aluminum alloy sheet is 11000 (MPa %) or more.

To reliably achieve this high strength-ductility balance and homogeneity within the sheet, the aforementioned aluminum alloy sheet is preferably manufactured by injecting an aluminum alloy melt comprising 8 to 14% Mg, 1.0% or less Fe and 0.5% or less Si by mass percentage, with Al constituting at least 97% of the remainder, into a pair of rotating twin rolls, and continuously casting to a thickness in the range of 1 to 13 mm with the cooling rate of the twin rolls at 100° C./s or more.

Moreover, to reliably achieve a high strength-ductility balance and homogeneity within the sheet, the surfaces of the aforementioned twin rolls are preferably not lubricated during continuous casting.

Mean conductivity in the present invention means the mean value of conductivity measured at any 5 locations at least 100 mm apart from one another on the part of the sheet to be formed. Moreover, an aluminum alloy sheet to be measured for mean conductivity is an aluminium alloy sheet which has been cast by twin-roll continuous casting rolled and finally annealed so as to obtain such material properties of aluminum alloy sheets as strength-ductility balance.

To achieve the aforementioned second object, the method for manufacturing an aluminum alloy sheet of the present invention is in essence a method for manufacturing an aluminum alloy thin sheet with a thickness of 0.5 to 3 mm by cold rolling an aluminum alloy sheet ingot with a thickness of 1 to 13 mm obtained by twin-roll continuous casting and comprising over 8% but not more than 14% Mg, 1.0% or less Fe and 0.5% or less Si by mass percentages with the remainder being Al and unavoidable impurities, wherein the mean cooling rate for casting is 50° C./s or more between injection into the twin rolls and solidification of the center of the sheet ingot, while in subsequent processes the mean temperature-rising rate is 5° C./s or more when the temperature of the center of the aforementioned sheet ingot or thin sheet is in the range of 200° C. to 400° C. while the sheet ingot or thin sheet is being heated to a temperature of 400° C. or more, and the mean cooling rate down to a temperature of 200° C. is 5° C./s or more while the sheet ingot or thin sheet is being cooled from a high temperature over 200° C.

In the present invention, heating the aforementioned sheet ingot or thin sheet to a temperature of 400° C. or more or cooling the sheet ingot or thin sheet from a high temperature over 200° C. constitutes a heat history process in which Al—Mg sires intermetallic compounds are likely to occur.

Examples of such heat history processes include the temperature range down to 200° C. when the aforementioned sheet ingot is cooled immediately after casting, homogenizing heat treatment between 400° C. and the liquidus temperature prior to cold rolling, cold rolling of the aforementioned sheet ingot when its temperature is 300° C. or more following casting, and final annealing between 400° C. and the liquidus temperature after cold rolling. These heat history processes are selectively included in the process design to improve the formability of the sheet or to improve manufacturing efficiency or yield in methods of manufacturing Al—Mg series alloy sheets of high-Mg by twin-roll continuous casting.

Effects of the Invention

In the aluminum alloy sheet of the present invention, the mean conductivity of the aluminum alloy sheet is restricted to the aforementioned range of at least 20 IACS % but less than 26 IACS % in an Al—Mg series alloy sheet structure of high-Mg with a Mg content over 8% following final annealing. In this way, the deposited states and amounts of all intermetallic compounds in the Al—Mg series alloy sheet structure of high-Mg, including not only specific intermetallic compounds of conventional Al—Mg series but also Al—Fe series and Al—Si series intermetallic compounds, are controlled overall.

In this way, the strength-ductility balance as a material property of an Al—Mg series alloy sheet of high-Mg with a Mg content over 8% is improved uniformly throughout the aluminum alloy sheet. Moreover, press formability by stretch forming, drawing, bending or a combination of these forming processes is also improved.

To control the mean conductivity of an aluminum alloy sheet in this way, it is necessary to control not only the composition of the alloy but also the manufacturing method and conditions increasing the cooling rate during twin-roll continuous casting or casting by using unlubricated twin rolls as described below.

Moreover, in the method for manufacturing the aluminum alloy sheet of the present invention, the mean temperature-rising rate is increased to 5° C./s or more and not reduced when the temperature of the center of the plate ingot or thin plate is in the range of 200° C. to 400° C. while the plate ingot or thin plate is being heated to a temperature of 400° C. or more in the aforementioned heat history processes following twin-roll continuous casting.

Moreover, the mean cooling temperature down to 200° C. is increased to 5° C./s or more and not reduced when the sheet ingot or thin sheet is being cooled from a high temperature over 200° C. in the aforementioned heat history processes following twin-roll continuous casting.

In this way, press formability of the Al—Mg series alloy sheer of high-Mg is improved by controlling the occurrence of Al—Mg series intermetallic compounds in each heat history process. Moreover, by controlling the occurrence of these Al—Mg series intermetallic compounds the deposited states and amounts of all intermetallic compounds are controlled, including other intermetallic compounds such as Al—Fe series and Al—Si series compounds which detract from press formability.

As a result, the strength-ductility balance as a material property of an Al—Mg series alloy sheet of high-Mg with a Mg content over 8% can be improved uniformly throughout the aluminum alloy sheet. Moreover, press formability by stretch forming, drawing, bending or a combination of these forming processes can also be improved.

BEST MODE FOR CARRYING OUT THE INVENTION (Mean Conductivity)

In the present invention, the mean conductivity of the aluminum alloy sheet is kept in the range of at least 20 IACS % but less than 26 IACS % in order to improve the strength-ductility balance of an Al—Mg series alloy sheet of high-Mg with a Mg content over 8%.

In such an Al—Mg series alloy sheet structure of high-Mg of the present invention, the strength-ductility balance of the sheet is greatly affected not only by the deposited amounts and states (shapes, sizes) of the intermetallic compounds of the Al—Mg series of the main phases but a so by the deposited amounts and states (shapes, sizes) of intermetallic compounds of Al—Fe series and Al—Si series. Regulating the deposited amounts and states of all of these intermetallic compounds is a difficult and complex task.

Therefore, in the present invention the deposited amounts and states of all of these intermetallic compounds are regulated in terms of the mean conductivity of the aluminum alloy sheet, which correlates across the board with all of these or in other words with the strength-ductility balance of the sheet.

In an Al—Mg series alloy sheet of high-Mg with a Mg content over 8%, when the mean conductivity of the aluminum alloy sheet is less than 20 IACS %, solid solution of Mg and the like proceeds and deposition of intermetallic compounds is too little, resulting in high ductility but low strength, and a strength-ductility balance (tensile strength×total elongation) of less than 11000 MPa %. Press formability is lower as a result, and the sheet is also less homogeneous.

Conversely, when the mean conductivity of the aluminum alloy sheet is 26 IACS % or more (26.0 IACS % or more) in an Al—Mg series alloy sheet of high-Mg with a Mg content over 8%, deposited amounts of intermetallic compounds (deposits) are too much, resulting in high strength but low ductility, and a strength-ductility balance (tensile strength×total elongation) of less than 11000 MPa %. Press formability is lower as a result, and the sheet is also less homogeneous.

Thus, by regulating and controlling the mean conductivity of the aluminum alloy sheet in the present invention, a strength-ductility balance (tensile strength×total elongation) of 11000 MPa % or more of the resulting aluminum alloy sheet for forming (product) is ensured as a uniform property of the material of all parts of the sheet used for forming.

Even if one location or some part of an aluminum allow sheet for forming exhibits a high strength-ductility balance in the best data, when there is variation in the material quality such that the strength-ductility balance of another location of the sheet used for forming is low, it cannot be used as an aluminum alloy sheet for forming. To be usable as an aluminum alloy sheet for forming, the resulting aluminum alloy sheet for forming (product) must have a strength-ductility balance (tensile strength×total elongation) of 11000 MPa % or more, with the material quality being uniform across all parts of the sheet used for forming.

To this end, the aforementioned strength-ductility balance and the uniformity of the strength-ductility balance throughout all parts of the sheet used for forming are ensured in the present invention by keeping the mean conductivity of an Al—Mg series alloy sheet of high-Mg with a Mg content over 8% within the range of 15 to 29 IACS %. However, for purposes of ensuring uniformity of the strength-ductility balance through-out all parts of the sheet used for forming it is of course preferable that the conductivity of all parts used for forming be 15 to 29 IACS % in the Al—Mg series alloy sheet of high-Mg with a Mg content over 8%.

To achieve a higher strength-ductility balance of 12000 MPa % or more which is also uniform throughout all parts of the sheet, the mean conductivity of the aforementioned aluminum alloy sheet is preferably in the range of 20 to 26 IACS %.

Conductivity can be measured on the aluminum alloy sheet surface by means of a commercial eddy conductivity measurement device. In this method, conductivity is measured at any 5 measurement locations 100 mm or more apart from one another on the part of the sheet to be formed, and these measurements are averaged to obtain mean conductivity. As mentioned above, the aluminum alloy sheet to be measured is an aluminum alloy sheet which has been cast by twin-roll continuous casting, cold rolled and finally annealed.

(Mean Crystalline Grain Size)

Restricting the mean crystalline grain size on the surface of an Al alloy sheet to 100 μm or less is desirable as a precondition for achieving the aforementioned strength-ductility balance. Press formability can be ensured or improved by keeping the crystalline grains fine and small within this range. Coarse crystalline grains in excess of 100 μm detract greatly from press formability and increase the likelihood of problems such as cracks and surface roughness during forming. If the mean crystalline gain size is too small, on the other hard, the SS (stretcher-strain) marks characteristic of 5000 series Al alloy sheets will occur during press forming, so the mean crystalline grain size is preferably at least 20 μm.

The mean crystalline grain size in the present invention means the maximum diameter of a crystalline grain in the direction of length (L) of a sheet. This crystalline grain size is measured by the line intercept method in the L direction under a light microscope at 100× on the surface of an Al alloy sheet which has been machine polished by 0.05 to 0.1 mm and then electrolyte etched. Given a measured line length of 0.95 mm, a total of 5 fields are observed with 3 lines per field, resulting in a total measured line length of 0.95×15 mm.

(Chemical Composition)

The significance and reasons for limiting the various alloy elements in the chemical composition of the Al alloy sheer of the present invention are explained below. An Al alloy sheet of the present invention i.e., an Al alloy sheet ingot manufactured by the twin-roll continuous casting method (or a melt supplied to twin rolls) has a chemical composition consisting of more than 8% and no more than 14% Ma, 1.0% or less Fe and 0.5% or less Si by mass.

(Mg: More than 8%, no More than 14%)

Mg is an important alloy element which improves the strength, ductility and strength-ductility balance of Al alloy sheets. When the Mg content is 8% or less, strength and ductility are inadequate, the properties of an Al—Mg series Al alloy of high-Mg do not appear, and in particular press formability into automobile panels, which is an object of the present invention, is inadequate. If the Mg content exceeds 14%, even if the manufacturing conditions are controlled by increasing the cooling rate during continuous casting or increasing the cooling rate after annealing for example, there is more crystal deposition of Al—Mg series compounds. As a result, press formability declines dramatically. Work hardening also increases, detracting from cold rollability. Consequently, the Mg content is in the range of more than 8% but no more than 14%.

(Fe: 1.0% or Less, Si: 0.5% or Less)

Fe and Si are impurities which are always present in the molten raw material of the melt and which should be minimized as much as possible. Much of the Fe and Si appears in the form of Al—Mg series compounds consisting of Al—Mg series-(Fe, Si) and the like and compounds other than Al—Mg series such as Al—Fe series and Al—Si series. When the Fe content exceeds 1.0% or the Si content exceeds 0.5%, the amount of these compounds is excessive, greatly detracting from fracture toughness and formability. Press formability also declines greatly as a result. Therefore, the Fe content is restricted to 1.0% or less or preferably 0.5% or less and the Si content to 0.5% or less or preferably 0.3% or less.

In addition, Mn, Cu, Cr, Zr, Zn, V, Ti, B and the like are impurities which are likely to occur in the molten raw material of the melt, and their content should be as small as possible. However, for example, Mn, Cr, Zr and V have the effect of creating a finer structure in rolled sheets, while Ti and B have the effect of creating a finer structure in cast sheets (ingots). Cu and Zn have the effect of increasing strength. For this reason they are sometimes included in order to achieve these effects, and inclusion of one or two or more of these elements is allowable to the extent that they do not extract from formability as a property of the sheet of the present invention. The tolerances are 0.3% or less Mn, 0.3% or less Cr, 0.3% or less Zr, 0.3% or less V, 0.1% or less Ti, 0.05% or less B, 1.0% or less Cu and 1.0% or less Zn by mass (Manufacturing Method)

The method for manufacturing an Al—Mg series Al alloy sheet of high-Mg with a Mg content over 8% of the present invention is explained below. As mentioned above, the Al—Mg series Al alloy sheet of high-Mg of the present invention is difficult to manufacture industrially by ordinary manufacturing methods in which a cast ingot cast by such as DC casting is hot rolled after being soaked. Consequently, the Al—Mg series Al alloy sheet of high-Mg of the present invention is manufactured by a combination of twin-roll or other continuous casting, cold rolling and annealing, with the hot rolling step omitted.

(Twin-Roll Continuous Casting)

In addition to the twin-roll method, methods of continuous casting Al alloy thin sheets include the belt caster method, properzi methods block caster method and the like, but the twin roll method is adopted in order to increase the cooling rate during casting as described below.

As discussed above, in twin-roll continuous castings an Al alloy thin sheet is produced by injecting an aluminum alloy melt of the aforementioned composition from a refractory supply nozzle and solidifying it between a rotating pair or water-cooled copper casting molds, and then pressing and rapidly cooling it between the twin rolls immediately after the aforementioned solidification.

(Roll Lubrication)

It is desirable as twin rolls to use such rolls that the surfaces are not lubricated with a lubricant. Conventionally, in order to prevent cracks in the solidified shell formed on the twin roll surfaces which occur when the melt contacts the roll surfaces and cools rapidly, lubricants (mold release agents) such as oxide powders (alumina powder, zinc oxide powder and the like) SiC powder, graphite powder, oil, molten glass and the like have been applied or poured on the surfaces of the twin rolls. However, when such lubricants are used, cooling is retarded and the necessary cooling rate cannot be obtained. This increases the likelihood that the mean conductivity of an Al—Mg series alloy sheet of high-Mg with a Mg content over 8% will tall outside the aforementioned stipulated range.

Moreover, when such lubricants are used, cooling is likely to be uneven due to variations in the concentration and thickness of the lubricant on the surface of the twin rolls, so that the solidification rate is likely to be insufficient on some parts of the sheet Consequently, the higher the Mg contents the greater the macro-segregation and micro-segregation become, increasing the likelihood of difficulty in creating a uniform strength-ductility balance in the Al—Mg series alloy sheet.

Japanese Patent Application Laid-open No. H1-202345 discloses that in twin-roll continuous casting of an Al—Mg series alloy sheet comprising 3.5% or more Mg, blemishes (surface segregation) due to uneven cooling are prevented to improve surface quality by using rolls the surfaces of which have not been lubricated with a lubricant. In this example, it is disclosed that the Mg content does not exceed 5%, though an Al—Mg series alloy sheet of high-Mg with a Mg content over 8% such as that of the present invention is not disclosed. That is it is unknown whether a lubricant should or should not be used in twin-roll continuous casting in the field of Al—Mg series alloy sheets of high-Mg with an Mg content over 8% such as that of the present invention, or what the effects would be, so in general lubricants are used as described above.

(Cooling Rate)

For example, even in the realm of relatively thin sheets with a cast thickness of 1 to 13 mm, the cooling rate for twin-roll casting needs to be as fast as possible, 50° C./s or more. When using the aforementioned lubricants, even if the cooling rate is high according to theoretic calculations, the actual or practical cooling rate is likely to be less than 50° C./s Consequently, the mean crystalline grain size is larger, over 50 μm, and overall intermetallic compounds such as Al—Mg series and other are larger or are deposited in larger quantities. As a result, conductivity is likely to fall outside the aforementioned range. The strength-ductility balance is likely to be lower as a result, detracting dramatically from press formability. The homogeneity of the sheet also declines.

Since the cooling rate is difficult to measure directly, it is instead calculated by known methods (described for example in Keikinzoku Gakkai, 20 Aug. 1988, "Aluminum dendrite arm spacing and measurement of cooling rate") from the dendrite arm spacing (DAS) of the cast sheet (ingot). That is, the average spacing d between adjacent secondary dendrite arms in the cast structure of a cast sheet is measured by the nodal line method (3 or more fields, 10 or more nodal points), and used in the formula $d=62\times c^{-0.337}$ (where d is the dendrite arm spacing in mm and C is the cooling rate in ° C./'s) so obtain the cooling rate.

(Cast Sheet Thickness)

The thickness of a thin sheet continuously cast with twin rolls is in the range of 1 to 13 mm. Preferably the thickness is 1 mm or more and less than 5 mm. Continuous casting of thicknesses less than 1 mm is difficult due to casting restrictions involved in injecting the melt between the two rolls and controlling the roll gap between the rolls. On the other hand, when the thickness exceeds 13 mm or more strictly 5 mm, the cooling rate for casting is much slower, and the Al—Mg series and other intermetallic compounds tend to be larger or to be deposited in greater numbers overall. This increases the likelihood that conductivity will fall outside the aforementioned range, which in turn increases the likelihood that the strength-ductility balance will fall, detracting dramatically from press formability (Melt Injection Temperature)

The melt injection temperature when injecting an Al alloy melt into twin rolls is preferably the liquidus temperature +30° C. or less When the injection temperature exceeds the liquidus temperature +30° C., the casting cooling rate described below falls, the overall Intermetallic compounds such as Al—Mg series and other become larger or are deposited in greater amounts, and conductivity may fall outside the aforementioned range. As a result, the strength-ductility balance declines, and press formability may be seriously affected. The twin roll reduction effect may also decline and central defects may increase, detracting from the basic mechanical properties of the Al alloy sheet itself.

(Twin Roll Circumferential Speed)

The circumferential speed of the rotating pair of twin rolls is preferably 1 m/min or more. If the circumferential speed of the twin rolls is less than 1 m/min, the contact time between the melt and mold (twin rolls) is longer, and the surface quality of the cast thin sheet may decline. For this reason the circumferential speed of the twin rolls should be as fast as possible preferably 30 m/min or more (Cold Rolling)

An Al alloy sheet cast in this way is cold rolled to a product thickness of 0.5 to 3 mm for automobile panels without being hot rolled either on line or off line, changing the cast structure into a worked structure. The degree of worked structure achieved depends upon the amount of reduction during cold rolling and some cast structure may remains but this is allowable to the extent that it does not adversely affect press formability or the mechanical properties. Intermediate annealing under ordinary conditions may also be included before or during cold rolling.

(Final Annealing)

The Al alloy cold-rolled sheet is preferably subjected to final annealing at a temperature between 400° C. and the liquidus temperature. If annealing is at a temperature below 400° C., the solution effect is likely not to be achieved. This final annealing needs to be followed by cooling at a relatively rapid mean cooling rate of 5° C./s or more in the temperature range of 500 to 300° C.

If the mean cooling rate after final annealing is slow, below 5° C./s, large amounts of overall intermetallic compounds such as Al—Mg series and other will be deposited. This makes it very likely that conductivity will fall outside the aforementioned range, reducing the strength-ductility balance, greatly detracting from press formability and probably reducing the homogeneity of the sheet.

(Heat History Processes)

In the present invention, as mentioned above, heating the aforementioned sheet ingot or thin sheet to a temperature of 400° C. or more or cooling the sheet ingot or thin sheet from a high temperature above 200° C. constitutes a heat history process sufficient to potentially produce Al—Mg series intermetallic compounds.

Also as mentioned above, these heat history processes are selectively included in the process design to improve the formability of the sheet or enhance manufacturing efficiency or yield in methods of manufacturing Al—Mg series alloy sheets of high-Mg by twin-roll continuous casting Consequently, when these heat history processes are selectively included in the manufacturing process either individually or in combination, each heat history process is performed under conditions which control the occurrence of Al—Mg series intermetallic compounds. The conditions for controlling occurrence of Al—Mg series intermetallic compounds during such heat history processes are explained below.

(Cooling Process Immediately after Casting)

When cooling a sheet ingot produced by twin-roll continuous casting to room temperature for example immediately after casting, if the cooling rate is slow within the temperature range down to 200° C. of the sheet ingot, Al—Mg series intermetallic compounds are highly likely to occur. Consequently, when such a cooling process is selectively included, the sheet ingot is cooled at a mean cooling rate of 5° C./s or more immediately after cooling until its temperature drops to 200° C. in order to control the occurrence of Al—Mg series intermetallic compounds.

(Homogenizing Heat Treatment)

When a sheet ingot produced by twin-roll continuous casting is subjected to selective homogenizing heat treatment (also refereed to as soaking or rough annealing) before cold rolling at temperatures between 400° C. and the liquidus temperature in order to homogenize the ingot, if the temperature-rising rate and cooling rate are too slow during the processes of ingot temperature increase and cooling, Al—Mg series intermetallic compounds are highly likely to occur. In particular, the temperature range at which Al—Mg series intermetallic compounds are most likely to occur is the range at which the temperature of the ingot center is 200° C. to 400° C. as the temperature rises and the range from the homogenizing heat treatment temperature down to 100° C. during cooling.

Consequently, when selectively performing such homogenizing heat treatments the mean temperature-rising rate is set at 5° C./s or more when the temperature of the ingot center is within the range of 200° C. to 400° C. in order to control the occurrence of Al—Mg series intermetallic compounds. For purposes of cooling from the homogenizing heat treatment temperature, the mean cooling rate is set at 5° C./s or more between the homogenizing heat treatment temperature and 100° C.

(Cold Rolling after Casting)

In some cases a sheet ingot produced by twin-roll continuous casting is cold rolled (or warm rolled) continuously for example without being cooled to room temperature immediately after casting in such cases, when the initial temperature for cold rolling (or warm rolling) is 300° C. or more, Al—Mg series intermetallic compounds are highly likely to occur during cold rolling.

Consequently, when the aforementioned sheet ingot with a temperature of 300° C. or more is selectively cold rolled (or warm rolled) after casting, either the mean cooling rate of the sheet during cold rolling (or during warm rolling) is set at 50° C./s or more, or the sheet is cooled at a mean cooling rate of 5° C./s or more after cold rolling (or after warm rolling).

(Final Annealing Following Cold Rolling)

When a sheet is selectively final annealed (also called solution treatment) after cold rolling at between 400° C. and the liquidus temperature, Al—Mg series intermetallic compounds are very likely to occur if the temperature-rising rate and cooling rate are slow during the processes of both temperature increase and cooling of the sheet. In particular, the temperature range at which Al—Mg series intermetallic compounds are most likely to occur is the range at which the temperature of the sheet center is 200° C. to 400° C. as the temperature rises to the final annealing temperature, and the range from the final annealing temperature down to 100° C. during cooling.

Consequently, when selectively performing such solution treatment, the mean temperature-rising rate is set at 5° C./s or more in order to control the occurrence of Al—Mg series intermetallic compounds when the temperature of the sheet center is within the range of 200° C. to 400° C. while heating to the final annealing temperature. For purposes of cooling from the final annealing temperature, the mean cooling rate is set at 5° C./s or more in the range between the final annealing temperature and 100° C.

In this way, press formability of the Al—Mg series alloy sheet of high-Mg is improved by controlling the occurrence of Al—Mg series intermetallic compounds during the various heat history processes. Moreover, by controlling the occurrence of these Al—Mg series intermetallic compounds it is also possible to control the deposited states and amounts of all intermetallic compounds including Al—Fe series, Al—Si series and other intermetallic compounds which detract from press formability.

The Al alloy cold-rolled sheet is preferably final annealed at between 400° C. and the liquidus temperature. If the annealing temperature is below 400° C. the solution effect is unlikely to be obtained.

(Cold Rolling)

in normal cold rolling in which the Al alloy sheet ingot is cooled to room temperature first rather than being cold rolled without being cooled to room temperature immediately after casting of the aforementioned sheet ingot, it is rolled to a product thickness of 0.5 to 3 mm for automobile panels without being hot rolled either on line or off line, changing the cast structure into a worked structure. The degree of worked structure achieved depends upon the amount of reduction during cold rolling, and some cast structure may remain, but this is allowable to the extent that it does no, detract from press formability or the mechanical properties.

Intermediate annealing under ordinary conditions may also be included during cold rolling, but in this case if intermediate annealing is at a temperature of 400° C. or more the conditions for the processes of temperature increase and cooling are the same as for the aforementioned final annealing so as to control the occurrence of Al—Mg series intermetallic compounds.

(Mean Crystalline Grain Size)

A small mean crystalline grain size of the Al alloy sheet surface, 100 μm or less, is desirable as a precondition for achieving strength-ductility balance. Keeping the crystalline grains small and fine in this range serves to ensure or improve press formability. If the crystalline grains are coarse, over 100 μm, press formability is much poorer and cracks, surface roughness and other problems are likely to occur during forming. If the mean crystalline grain size is too fine, on the other hand, the SS (stretcher-strain) marks characteristic of 5000 series Al alloy sheets will occur during press forming, so the mean crystalline grain size is preferably at least 20 μm.

The mean crystalline grain size in the present invention means the maximum diameter of a crystalline grain in the direction of length (TL) of a sheet. This crystalline grain size is measured by the line intercept method in the L direction under a light microscope at 100× on the surface of an Al alloy sheet which has been machine polished by 0.05 to 0.1 mm and electrolyte etched. Given a measured line length of 0.95 mm a total of 5 fields are observed with 3 lines per field, resulting in a total measured line length of 0.95×15 mm.

EXAMPLE 1

Example 1 of the present invention is explained below. Al—Mg series Al alloy melts (invention examples A to M, comparative examples N to X) with the various chemical compositions shown in Table 1 were cast to various sheet thicknesses (3 to 5 mm) under the conditions shown in Table 2 by the aforementioned twin-roll continuous casting. These Al alloy cast thin sheets were then cold rolled to a thickness of 1.5 mm. Then these cold-rolled sheets were final annealed in a continuous annealing furnace and cooled under the conditions shown in Table 2. In these invention examples and comparatives examples, the mean crystalline grain size of the Al alloy sheet surface was in the range of 30 to 60 μm.

When twin-roll continuous casting, the circumferential speed was fixed at 70 m/min and the injection temperature for injecting the Al alloy melt into the twin rolls was fixed at the liquidus temperature +20° C. for all examples. Lubrication of the twin roll surfaces with a lubricant consisting of SiC and alumina powder suspended in water was performed only in comparative examples 15 and 16 in Table 2, while in the other examples continuous casting was performed without any lubrication of the twin roll surfaces (unlubricated).

The mean value (IACS %) for conductivity of each sheet was calculated from measurements at five measurement locations 100 nm or more apart from each other in the longitudinal direction on the part to be press formed or each final annealed Al—Mg series Al alloy sheet of high-Mg. A Δ conductivity value (IACS %) representing the difference between the maximum and minimum of these conductivity values was also calculated to evaluate the homogeneity of the sheet.

Test pieces were also collected from the aforementioned conductivity measurement locations, and the mechanical properties of each test piece were measured along with a mean value for strength-ductility balance [tensile strength (TS:MPa)×total elongation EL:%] (MPa %). Five test pieces were also collected randomly for each test from sites at least 100 ml apart from each other in the longitudinal direction on the part of the sheet to be press formed and the properties such as press formability were measured and evaluated. The results are shown in Table 3.

Tensile testing was done in accordance with JIS Z 2201, with the test pieces in the form of JIS #5 test pieces made so that the longitudinal direction of the test pieces corresponds to the direction of rolling. Testing was done at a crosshead speed of 5 mm/minute, with the speed fixed until the test piece broke down.

An Erichsen test (mm) was performed in accordance with JIS Z 2247 as a material test evaluation for formability.

The obtained Al—Mg series Al alloy sheets of high-Mg were also press formed and bent to evaluate their formability as actual outer automobile panels. The results are shown in Table 3.

In the press forming test, of the aforementioned collected test pieces (square blanks 200 mm on a side) stretch formed with a mechanical press into hat-shaped panels having square tubular extensions, 60 mm on a side and 30 mm in height in the center and flat flanges on all four sides of these extensions. In all cases the hold-down force was 49 kN, the lubricating oil was ordinary rust-proofing oil, and the forming speed was 20 mm/minute.

A rating of O is given if there was no cracking of any of the flat flanges around the aforementioned extensions in any of the 5 press formings (5 pieces), Δ if no cracking occurred in any of the 5 press formings but there were SS marks or surface roughness, and X if the aforementioned cracking occurred even once.

Bendability was evaluated by a bending test after the aforementioned collected test pieces had been stretched by 10% at room temperature to simulate flat hemming following press forming of an outer automobile panel. The aforementioned collected test pieces were prepared using #3 test pieces (W 30 mm×L 200 mm) conforming to JIS Z 2204 so that longitudinal direction of each test piece matched the direction of rolling. The bending test was performed in accordance with the V block method stipulated by JIS Z 2248 by first bending at a 60° angle using a pressing tool with a tip radius of 0.3 mm and a bending angle of 60°, and then bending at 180° to simulate flat hemming. An inner panel may be inserted into the bend when the outer panel is hemmed for example, but in this case the pieces were bent at 180° without insertion of such an Al alloy sheet in order to make the conditions stricter.

The occurrence of cracks was then observed in the bent part (curved portion) after the bending test, a rating of O is given if there was no cracking, surface roughness or other abnormalities of the surface of the bent part in any of the 5 tests (5 pieces), Δ if cracking did not occur in any of the 5 tests but surface roughness occurred, and X if cracking occurred even once.

As shown in Tables 1 and 2, in invention examples 1 through 14 which were examples of Al—Mg series Al alloy sheets of high-Mg having compositions A through M in Table 1 within the range of the present invention and which were twin-roll continuously cast, cold rolled and final annealed under the range of conditions of the present invention, not only is conductivity in the range of the present invention, but the Δ conductivity value representing variation in conductivity is low, and the strength-ductility balance is both high and uniform, indicating that press formability is excellent and homogenous throughout all parts of the sheets.

By contrast, while comparative examples 15 and 16 are examples of Al—Mg series Al alloys of high-Mg having compositions A and B in Table 1 within the range of the present invention, they were manufactured outside the range of desirable manufacturing conditions, with the twin rolls lubricated at a cooling rate of less than 100° C./s. As a results conductivity falls outside the range of the present invention tin comparative examples 15 and 16 and the strength-ductility balance is poor, as are bendability and press formability. Homogeneity of the sheets is also poor as indicated by the high Δ conductivity values.

Comparative example 17 is also an example of an Al—Mg series Al alloy of high-Mg having a composition B in Table 1 within the range of the present invention, but in this case the cooling rate was low during final annealing. As a result, conductivity falls outside the range of the present invention in comparative example 17, and the strength-ductility balance is poor, as are bendability and press formability. Homogeneity of the sheets is also poor as indicated by the high Δ conductivity value.

In comparative examples 18 through 28 using alloys having compositions N through X in Table 1 outside the range of the present invention, although the conditions for twin-roll continuous casting, cold rolling and final annealing were within the preferred range, press formability is much poorer than in the invention examples.

Because comparative example 18 uses alloy N which has a Mg content below the lower limit, the conductivity is too low. As a result, the strength-ductility balance is poor, as are bendability and press formability.

Because comparative example 19 uses alloy O which has a Mg content above the upper limit, conductivity is too high. As a result, the strength-ductility balance is poor, as are bendability and press formability. This illustrates the critical significance of Mg content for strength, ductility, strength-ductility balance and formability.

Comparative example 20 uses alloy P, which has a Fe content above the upper limit.

Comparative example 21 uses alloy Q, which has a Si content above the upper limit.

Comparative example 22 uses alloy R, which has a Mn content above the upper limit.

Comparative example 23 uses alloy S, which has a Cr content above the upper limit.

Comparative example 24 uses alloy T, which has a Zr content above the upper limit.

Comparative example 25 uses alloy U, which has a V content above the upper limit.

Comparative example 26 uses alloy V, which has a Ti content above the upper limit.

Comparative example 27 uses alloy W, which has a Cu content above the upper limit.

Comparative example 28 uses alloy X, which has a Zn content above the upper limit.

As a result, the strength-ductility balance is poor in these comparative examples, as are bendability and press formability. This illustrates the critical significance of these elements for strength, ductility, strength-ductility balance and formability.

TABLE 1

| | | Chemical composition of A1 alloy sheet (mass %, remainder A1) | | | | | | | | | | |
|---|---|---|---|---|---|---|---|---|---|---|---|---|
| Type | Abbrev. | Mg | Fe | Si | Ti | B | Mn | Cr | Zr | V | Cu | Zn |
| Invention | A | 8.1 | 0.25 | 0.21 | 0.01 | 0.002 | — | — | — | — | — | — |
| example | B | 10.5 | 0.25 | 0.21 | 0.01 | 0.002 | — | — | — | — | — | — |
| | C | 13.8 | 0.25 | 0.21 | 0.01 | 0.002 | — | — | — | — | — | — |

TABLE 1-continued

| Type | Abbrev. | Chemical composition of A1 alloy sheet (mass %, remainder A1) | | | | | | | | | | |
|---|---|---|---|---|---|---|---|---|---|---|---|---|
| | | Mg | Fe | Si | Ti | B | Mn | Cr | Zr | V | Cu | Zn |
| | D | 10.5 | 0.90 | 0.21 | 0.01 | 0.002 | — | — | — | — | — | — |
| | E | 10.5 | 0.25 | 0.50 | 0.01 | 0.002 | — | — | — | — | — | — |
| | F | 10.5 | 0.25 | 0.21 | 0.01 | 0.002 | 0.20 | — | — | — | — | — |
| | G | 10.5 | 0.25 | 0.21 | 0.01 | 0.002 | — | 0.20 | — | — | — | — |
| | H | 10.5 | 0.25 | 0.21 | 0.01 | 0.002 | — | — | 0.20 | — | — | — |
| | I | 10.5 | 0.25 | 0.21 | 0.01 | 0.002 | — | — | — | 0.20 | — | — |
| | J | 10.5 | 0.25 | 0.21 | 0.08 | 0.002 | — | — | — | — | — | — |
| | K | 10.5 | 0.25 | 0.21 | 0.01 | 0.002 | — | — | — | — | 0.80 | — |
| | L | 10.5 | 0.25 | 0.21 | 0.01 | 0.002 | — | — | — | — | — | 0.80 |
| | M | 10.5 | 0.25 | 0.21 | 0.01 | 0.002 | — | — | 0.20 | — | 0.80 | — |
| Comparative example | N | 7.6 | 0.25 | 0.21 | 0.01 | 0.002 | — | — | — | — | — | — |
| | O | 15.0 | 0.25 | 0.21 | 0.01 | 0.002 | — | — | — | — | — | — |
| | P | 10.5 | 1.10 | 0.21 | 0.01 | 0.002 | — | — | — | — | — | — |
| | Q | 10.5 | 0.25 | 0.60 | 0.01 | 0.002 | — | — | — | — | — | — |
| | R | 10.5 | 0.25 | 0.21 | 0.01 | 0.002 | 0.40 | — | — | — | — | — |
| | S | 10.5 | 0.25 | 0.21 | 0.01 | 0.002 | — | 0.40 | — | — | — | — |
| | T | 10.5 | 0.25 | 0.21 | 0.01 | 0.002 | — | — | 0.40 | — | — | — |
| | U | 10.5 | 0.25 | 0.21 | 0.01 | 0.002 | — | — | — | 0.40 | — | — |
| | V | 10.5 | 0.25 | 0.21 | 0.15 | 0.002 | — | — | — | — | — | — |
| | W | 10.5 | 0.25 | 0.21 | 0.01 | 0.002 | — | — | — | — | 1.20 | — |
| | X | 10.5 | 0.25 | 0.21 | 0.01 | 0.002 | — | — | — | — | — | 1.20 |

* In describing content, — indicates a content of less than 0.002% (below the detection limit)

TABLE 2

| Type | Abbrev. | Alloy Table 1 | Twin-roll continuous casting | | | Cold rolling | Final annealing | | Properties of A1 alloy sheet | |
|---|---|---|---|---|---|---|---|---|---|---|
| | | | Roll lubrication | Cooling rate ° C./s | Sheet thickness mm | Sheet thickness mm | Temp. ° C. | Cooling rate ° C./s | Conductivity IACS % | Δ Conductivity IACS % |
| Invention example | 1 | A | None | 800 | 5 | 1.5 | 450 | 10.0 | 25.3 | 0.3 |
| | 2 | B | None | 200 | 5 | 1.5 | 450 | 10.0 | 22.9 | 0.2 |
| | 3 | B | None | 800 | 3 | 1.5 | 450 | 10.0 | 22.5 | 0.4 |
| | 4 | C | None | 800 | 3 | 1.5 | 450 | 10.0 | 20.1 | 0.4 |
| | 5 | D | None | 800 | 3 | 1.5 | 450 | 10.0 | 22.1 | 0.3 |
| | 6 | E | None | 800 | 3 | 1.5 | 450 | 10.0 | 22.0 | 0.3 |
| | 7 | F | None | 800 | 3 | 1.5 | 450 | 10.0 | 21.9 | 0.5 |
| | 8 | G | None | 800 | 3 | 1.5 | 450 | 10.0 | 22.4 | 0.5 |
| | 9 | H | None | 800 | 3 | 1.5 | 450 | 10.0 | 22.3 | 0.5 |
| | 10 | I | None | 800 | 3 | 1.5 | 450 | 10.0 | 22.4 | 0.5 |
| | 11 | J | None | 800 | 3 | 1.5 | 450 | 10.0 | 22.5 | 0.4 |
| | 12 | K | None | 800 | 3 | 1.5 | 450 | 10.0 | 22.0 | 0.5 |
| | 13 | L | None | 800 | 3 | 1.5 | 450 | 10.0 | 22.1 | 0.4 |
| | 14 | M | None | 800 | 3 | 1.5 | 450 | 10.0 | 21.8 | 0.2 |
| Comparative example | 15 | A | Provided | 80 | 5 | 1.5 | 450 | 10.0 | 27.5 | 1.2 |
| | 16 | B | Provided | 80 | 5 | 1.5 | 450 | 10.0 | 26.2 | 1.1 |
| | 17 | B | None | 800 | 3 | 1.5 | 450 | 0.5 | 27.0 | 0.7 |
| | 18 | N | None | 800 | 3 | 1.5 | 450 | 10.0 | 26.1 | 0.9 |
| | 19 | O | None | 800 | 3 | 1.5 | 450 | 10.0 | 18.8 | 0.6 |
| | 20 | P | None | 800 | 3 | 1.5 | 450 | 10.0 | 19.5 | 0.8 |
| | 21 | Q | None | 800 | 3 | 1.5 | 450 | 10.0 | 19.0 | 0.8 |
| | 22 | R | None | 800 | 3 | 1.5 | 450 | 10.0 | 21.3 | 0.7 |
| | 23 | S | None | 800 | 3 | 1.5 | 450 | 10.0 | 21.9 | 0.8 |
| | 24 | T | None | 800 | 3 | 1.5 | 450 | 10.0 | 21.8 | 0.9 |
| | 25 | U | None | 800 | 3 | 1.5 | 450 | 10.0 | 21.9 | 0.8 |
| | 26 | V | None | 800 | 3 | 1.5 | 450 | 10.0 | 21.8 | 0.7 |
| | 27 | W | None | 800 | 3 | 1.5 | 450 | 10.0 | 21.0 | 0.6 |
| | 28 | X | None | 800 | 3 | 1.5 | 450 | 10.0 | 21.1 | 0.6 |

| Type | Abbrev. | Properties of A1 alloy sheet | | | | | | |
|---|---|---|---|---|---|---|---|---|
| | | Tensile strength MPa | 0.2% proof stress MPa | Total elongation % | TS × EL MPa % | Bend-ability | Erichsen value mm | Press formability |
| Invention example | 1 | 370 | 200 | 37 | 13690 | ○ | 10.7 | ○ |
| | 2 | 385 | 205 | 38 | 14630 | ○ | 10.8 | ○ |
| | 3 | 395 | 212 | 39 | 15405 | ○ | 11.0 | ○ |
| | 4 | 390 | 209 | 38 | 14820 | ○ | 10.8 | ○ |
| | 5 | 360 | 191 | 36 | 12960 | ○ | 10.5 | ○ |
| | 6 | 355 | 188 | 35 | 12425 | ○ | 10.5 | ○ |

TABLE 2-continued

| | | | | | | | | |
|---|---|---|---|---|---|---|---|---|
| | 7 | 395 | 195 | 38 | 15010 | ○ | 10.8 | ○ |
| | 8 | 400 | 201 | 37 | 14800 | ○ | 10.8 | ○ |
| | 9 | 400 | 200 | 37 | 14800 | ○ | 10.7 | ○ |
| | 10 | 395 | 198 | 36 | 14220 | ○ | 10.6 | ○ |
| | 11 | 400 | 195 | 37 | 14800 | ○ | 10.6 | ○ |
| | 12 | 405 | 210 | 35 | 14175 | ○ | 10.5 | ○ |
| | 13 | 400 | 208 | 36 | 14400 | ○ | 10.6 | ○ |
| | 14 | 405 | 195 | 36 | 14580 | ○ | 10.6 | ○ |
| Comparative example | 15 | 330 | 175 | 30 | 9900 | X | 9.7 | X |
| | 16 | 340 | 180 | 31 | 10540 | X | 9.8 | X |
| | 17 | 320 | 170 | 30 | 9600 | X | 9.7 | X |
| | 18 | 345 | 183 | 30 | 10350 | X | 9.8 | X |
| | 19 | 350 | 186 | 34 | 11900 | Δ | 10.2 | Δ |
| | 20 | 350 | 185 | 33 | 11550 | Δ | 9.9 | Δ |
| | 21 | 345 | 183 | 33 | 11385 | Δ | 10.0 | Δ |
| | 22 | 355 | 190 | 32 | 11360 | X | 9.8 | X |
| | 23 | 360 | 198 | 30 | 10800 | X | 9.3 | X |
| | 24 | 350 | 195 | 31 | 10850 | X | 9.5 | X |
| | 25 | 345 | 190 | 30 | 10350 | X | 9.2 | X |
| | 26 | 360 | 192 | 30 | 10800 | X | 9.4 | X |
| | 27 | 360 | 195 | 29 | 10440 | X | 9.2 | X |
| | 28 | 365 | 200 | 29 | 10585 | X | 9.2 | X |

EXAMPLE 2

Example 2 of the present invention is explained below. Al—Mg series Al alloy melts (invention examples A-I, comparative examples J to M) having the various chemical compositions shown in Table 3 were cast into sheet ingots (thickness 3 to 5 mm in each case) by the aforementioned twin-roll continuous casting. Cold-rolled sheets (thickness 1.5 mm in each case) were then manufactured from the respective sheet ingots (Al alloy cast thin sheets) under the specific process conditions shown in Table 5 for the respective manufacturing methods shown in Table 4. In all of the invention examples and comparative examples with the exception of comparative example 13, the mean crystalline grain size of the resulting Al alloy sheet surface was in the range of 30 to 60 μm.

In all cases the circumferential speed of the twin rolls was set at 70 m/min for twin-roll continuous casting, while the injection temperature during injection of the Al alloy melt into the twin rolls was set at the liquidus temperature +20° C. A lubricant consisting of SiC and alumina powder suspended in water was applied to lubricate the twin roll surfaces only in comparative examples 15 and 16 in Table 2, while in the other examples continuous casting was performed without lubrication of the twin roll surfaces.

Test pieces were collected from any 5 measurement locations 100 mm or more apart from each other in the longitudinal direction on the part to be press formed on each final annealed Al—Mg series Al alloy sheet of high-Mg, and evaluated.

The structure of each test piece was observed at 250× under a scanning electron microscope, and the mean grain size (μm) and mean area ratio (%) of Al—Mg series intermetallic compounds in the visual field were measured and averaged. The Al—Mg series intermetallic compounds (deposits) within the structure (visual field) were identified and distinguished by x-ray diffraction, the maximum grain size of the individual Al—Mg series intermetallic compounds observed was measured and averaged, and the average for all of the aforementioned test pieces was given as the mean grain size. For the area ratio, the area within the visual field occupied by all observed Al—Mg series intermetallic compounds was obtained from image analysis and averaged for all the aforementioned test pieces to obtain a mean area ratio.

The mechanical properties of each test piece were also measured along with a mean value for strength-ductility balance [tensile strength (TS: MPa)×total elongation (L: %)] (Pa %).

Tensile testing was done in accordance with JIS Z 2201 as in Example 1, with the test pieces in the form of JIS #5 test pieces made so that the longitudinal direction of the test pieces corresponds to the direction of rolling. Testing was done at a crosshead speed of 5 mm/minute, at a fixed speed until the test piece broke down.

An, Erichsen test (mm) was performed in accordance with JIS Z 2247 as a material test evaluation for formability of each sample. The results are shown in Table 6.

5 blanks were also collected from locations 100 mm apart from one another in the longitudinal direction on the part of the sheet to be press formed, and tested and evaluated for formability and other properties. The results are shown in Table 6.

The obtained Al—Mg series Al alloy sheets of high-Mg were also press formed and bent to evaluate their formability as actual outer automobile panels.

In the press forming test, as in example 1, 5 of the aforementioned collected test pieces (square blanks 200 mm on a side) were stretch formed with a mechanical press into hat-shaped panels having square tubular extensions 60 mm on a side and 30 mm in height in the center and flat flanges on all four sides of these extensions. In all cases the hold-down force was 49 kN, the lubricating oil was ordinary rust-proofing oil, and the forming speed was 20 mm/minute.

A rating of O is given if there was no cracking of any of the flat flanges around the aforementioned extensions in any of the 5 press forming (5 pieces) Δ if no cracking occurred in any of the 5 press formings but there were SS marks or surface roughness, and X if the aforementioned cracking occurred even once.

As in example 1, bendability was evaluated by a bending test after the aforementioned collected test pieces had been stretched by 10% at room temperature to simulate flat hemming after press forming of an outer automobile panel. The test pieces were prepared using #3 test pieces (W 30 mm×L 200 mm) conforming to JIS Z 2204 so that longitudinal direction of each test piece matched the direction of rolling. The bending test was performed in accordance with the V block method stipulated by JIS Z 2248 by first bending at a 60° angle using a pressing tool with a tip radius of 0.3 mm and a bending angle of 60°, and then bending at 180° to simulate flat hemming. An inner panel may be inserted into the bend when the outer panel is hemmed for example, but in this case the pieces were bent at 180° without the insertion of such an Al alloy sheet in order to make the conditions more strict.

The occurrence of cracks was then observed in the bent part (curved portion; after the bending test, and a rating of O is given if there was no cracking, surface roughness or other abnormalities of the surface of the bent part in any of the 5 tests (5 pieces), Δ if cracking did not occur in any of the 5 tests but surface roughness occurred, and X if cracking occurred even once.

As shown in Tables 3 through 6, invention examples 1 through 12 having compositions A through I in Table 3 within the range of the present invention were examples of Al—Mg series Al alloy sheets of high-Mg which were cast with a mean cooling rate of 50° C./s or more between injection into the twin rolls and solidification of the center of the aforementioned sheet ingot, while in the subsequent heat history processes the mean temperature-rising rate was 5° C./s or more when the temperature of the center of the aforementioned sheet ingot or thin sheet was between 200° C. and 400° C. during heating of the aforementioned sheet ingot or thin sheet to a temperature above 400°, and the mean cooling rate was 5° C./s or more down to a temperature of 200° during cooling of the sheet ingot or thin sheet from a high temperature over 200° C.

As a result, even following the post-casting heat history processes in examples 1 through 12, the mean grain diameter (μm) and mean area ratio (%) of the Al—Mg series intermetallic compounds are small, the strength-ductility balances are high, press formability is high and these properties are homogenous throughout all parts of the sheets.

By contrast, while comparative example 13 is an example of an alloy having a composition B in Table 3 within the range of the present invention, the rolls were lubricated and the cooling rate for casting was too low, less than 50° C./s. As a result, the mean grain diameter (μm) and mean area ratio (%) of the Al—Mg series intermetallic compounds are greater in comparative example 13 than in the invention examples. The mean crystalline grain size was also larger, 300 μm. As a result, the strength-ductility balance is poor in comparative example 13, as are bendability and press formability. The sheet is also less homogeneous.

While comparative examples 14 through 18 involve Al—Mg series alloys within the range of the present invention of B in Table 3, either the aforementioned mean temperature-rising rate or cooling rate is too slow in one of the heat history processes following casting. As a result, the mean grain diameter (μm) and mean area ratio (%) of the Al—Mg series intermetallic compounds are greater in comparative examples 14 through 18 than in invention examples 1 through 14 and the strength-ductility balance is poor, as are bendability and press formability. The sheet is also less homogenous.

In comparative examples 19 through 22, which use alloys having compositions J through M in Table 3 outside the range of the present invention, bendability and press formability are much poorer than in the invention examples even though the manufacturing conditions are within the range of the present invention in the heat history processes following casting.

Because comparative example 19 uses alloy J which has a Mg content below the lower limit, the strength-ductility balance is poor, as are bendability and press formability.

Because comparative example 20 uses alloy K which has a Mg content above the upper limit, the strength-ductility balance is poor, as are bendability and press formability. This illustrates the critical significance of Mg content for strength, ductility, strength-ductility balance and formability.

Comparative example 21 uses alloy L, which has a Fe content above the upper limit. Comparative example 22 uses alloy M, which has an Si content above the upper limit. As a result, in these comparative examples the strength-ductility balance is poor, as are bendability and press formability. This illustrates the critical significance of these elements for strength, ductility strength-ductility balance and formability.

TABLE 3

| | | Chemical composition of A1 alloy sheet (mass %, remainder A1) | | | | | | | | | | |
|---|---|---|---|---|---|---|---|---|---|---|---|---|
| Type | Abbrev. | Mg | Fe | Si | Ti | B | Mn | Cr | Zr | V | Cu | Zn |
| Invention | A | 8.1 | 0.25 | 0.21 | 0.01 | 0.002 | — | — | — | — | — | — |
| example | B | 10.5 | 0.25 | 0.21 | 0.01 | 0.002 | — | — | — | — | — | — |
| | C | 13.8 | 0.25 | 0.21 | 0.01 | 0.002 | — | — | — | — | — | — |
| | D | 10.5 | 0.90 | 0.21 | 0.01 | 0.002 | — | — | — | — | — | — |
| | E | 10.5 | 0.25 | 0.50 | 0.01 | 0.002 | — | — | — | — | — | — |
| | F | 10.5 | 0.25 | 0.21 | 0.03 | 0.002 | 0.20 | 0.20 | — | — | — | — |
| | G | 10.5 | 0.25 | 0.21 | 0.03 | 0.002 | — | — | 0.20 | 0.20 | — | — |
| | H | 10.5 | 0.25 | 0.21 | 0.03 | 0.002 | — | — | — | — | 0.80 | 0.80 |
| | I | 10.5 | 0.25 | 0.21 | 0.01 | 0.002 | — | — | 0.20 | — | 0.80 | — |
| Comparative | J | 7.6 | 0.25 | 0.21 | 0.01 | 0.002 | — | — | — | — | — | — |
| example | K | 15.0 | 0.25 | 0.21 | 0.01 | 0.002 | — | — | — | — | — | — |
| | L | 10.5 | 1.10 | 0.21 | 0.01 | 0.002 | — | — | — | — | — | — |
| | M | 10.5 | 0.25 | 0.60 | 0.01 | 0.002 | — | — | — | — | — | — |

* In describing content, — indicates a content of less than 0.002% (below the detection limit)

TABLE 4

| Manufacturing method type | Processes |
|---|---|
| 1 | Twin-roll continuous casting (cooled to room temperature) → cold rolling→final annealing |
| 2 | Twin-roll continuous casting (cooled to room temperature) → homogenizing heat treatment → cold rolling → final annealing |
| 3 | Twin-roll continuous casting → cold rolled at 300° C. or more → final annealing |

TABLE 5

| | | | | Twin-roll continuous casting | | | | Homogenizing heat treatment | | |
|---|---|---|---|---|---|---|---|---|---|---|
| Type | Abbrev. | Alloy Table 3 | Manufacturing method type | Roll lubrication | Cooling rate ° C./s | Mean cooling rate to 200° C. after casting ° C./s | Sheet thickness mm | Temp. ° C. | Mean Temp. - rising rate during 200~400° C. ° C./s | Mean cooling rate to 200° C. ° C./s |
| Invention example | 1 | A | 1 | None | 800 | 10 | 3 | None | — | — |
| | 2 | B | 1 | None | 800 | 10 | 3 | None | — | — |
| | 3 | B | 2 | None | 800 | 10 | 3 | 460 | 10 | 10 |
| | 4 | B | 3 | None | 800 | 10 | 3 | None | — | — |
| | 5 | B | 3 | None | 800 | 10 | 3 | None | — | — |
| | 6 | C | 1 | None | 800 | 10 | 3 | None | — | — |
| | 7 | D | 1 | None | 800 | 10 | 3 | None | — | — |
| | 8 | E | 1 | None | 800 | 10 | 3 | None | — | — |
| | 9 | F | 1 | None | 800 | 10 | 3 | None | — | — |
| | 10 | G | 1 | None | 800 | 10 | 3 | None | — | — |
| | 11 | H | 1 | None | 800 | 10 | 3 | None | — | — |
| | 12 | I | 1 | None | 800 | 10 | 3 | None | — | — |
| Comparative example | 13 | B | 1 | Provided | 45 | 10 | 4 | None | — | — |
| | 14 | B | 1 | None | 800 | 1 | 3 | None | — | — |
| | 15 | B | 1 | None | 800 | 10 | 3 | None | — | — |
| | 16 | B | 2 | None | 800 | 10 | 3 | 450 | 1 | 10 |
| | 17 | B | 2 | None | 800 | 10 | 3 | 450 | 10 | 1 |
| | 18 | B | 3 | None | 800 | 10 | 3 | None | — | — |
| | 19 | J | 1 | None | 800 | 10 | 3 | None | — | — |
| | 20 | K | 1 | None | 800 | 10 | 3 | None | — | — |
| | 21 | L | 1 | None | 800 | 10 | 3 | None | — | — |
| | 22 | M | 1 | None | 800 | 10 | 3 | None | — | — |

| | | Cold rolling | | | | Final annealing | | |
|---|---|---|---|---|---|---|---|---|
| Type | Abbrev. | Initial cold rolling Temp. | Mean cooling rate during cold rolling ° C./s | Mean cooling rate after cold rolling ° C./s | Sheet thickness mm | Temp. ° C. | Mean Temp. - rising rate during 200~400° C. ° C./s | Mean cooling rate to 200° C. ° C./s |
| Invention example | 1 | Room Temp. | — | — | 1.5 | 450 | 10 | 10.0 |
| | 2 | Room Temp. | — | — | 1.5 | 450 | 10 | 10.0 |
| | 3 | Room Temp. | — | — | 1.5 | 450 | 10 | 10.0 |
| | 4 | 450 | 60 | 10 | 1.5 | 450 | 10 | 10.0 |
| | 5 | 350 | 60 | 10 | 1.5 | 450 | 10 | 10.0 |
| | 6 | Room Temp. | — | — | 1.5 | 450 | 10 | 10.0 |
| | 7 | Room Temp. | — | — | 1.5 | 450 | 10 | 10.0 |
| | 8 | Room Temp. | — | — | 1.5 | 450 | 10 | 10.0 |
| | 9 | Room Temp. | — | — | 1.5 | 450 | 10 | 10.0 |
| | 10 | Room Temp. | — | — | 1.5 | 450 | 10 | 10.0 |
| | 11 | Room Temp. | — | — | 1.5 | 450 | 10 | 10.0 |
| | 12 | Room Temp. | — | — | 1.5 | 450 | 10 | 10.0 |
| Comparative example | 13 | Room Temp. | — | — | 1.5 | 450 | 10 | 10.0 |
| | 14 | Room Temp. | — | — | 1.5 | 450 | 10 | 10.0 |
| | 15 | Room Temp. | — | — | 1.5 | 450 | 0.5 | 0.5 |
| | 16 | Room Temp. | — | — | 1.5 | 450 | 10 | 10.0 |
| | 17 | Room Temp. | — | — | 1.5 | 450 | 10 | 10.0 |
| | 18 | 450 | 45 | 1 | 1.5 | 450 | 10 | 10.0 |
| | 19 | Room Temp. | — | — | 1.5 | 450 | 10 | 10.0 |
| | 20 | Room Temp. | — | — | 1.5 | 450 | 10 | 10.0 |
| | 21 | Room Temp. | — | — | 1.5 | 450 | 10 | 10.0 |
| | 22 | Room Temp. | — | — | 1.5 | 450 | 10 | 10.0 |

TABLE 6

| | | | | A1 -Mg series compound | | | Properties of A1 alloy sheet | | | | | |
|---|---|---|---|---|---|---|---|---|---|---|---|---|
| Type | Abbrev. | Alloy Table 3 | Manufacturing method type | Mean grain size μm | Mean area ratio % | Tensile strength MPa | 0.2% proof stress Mpa | Total elongation % | TS × EL MPa % | Erichson value mm | Bendability | Press formability |
| Invention example | 1 | A | 1 | 4.5 | 0.9 | 354 | 191 | 35 | 12390 | 10.7 | ○ | ○ |
| | 2 | B | 1 | 6.2 | 1.0 | 378 | 202 | 37 | 13986 | 11.0 | ○ | ○ |
| | 3 | B | 2 | 6.4 | 1.0 | 384 | 200 | 39 | 14976 | 11.0 | ○ | ○ |
| | 4 | B | 3 | 6.6 | 1.1 | 381 | 200 | 38 | 14478 | 10.9 | ○ | ○ |
| | 5 | B | 3 | 7.0 | 1.2 | 385 | 203 | 40 | 15400 | 11.0 | ○ | ○ |
| | 6 | C | 1 | 8.1 | 1.4 | 373 | 200 | 36 | 13428 | 10.8 | ○ | ○ |
| | 7 | D | 1 | 9.8 | 1.6 | 344 | 182 | 34 | 11696 | 10.5 | ○ | ○ |
| | 8 | E | 1 | 8.5 | 4.6 | 339 | 179 | 33 | 11187 | 10.5 | ○ | ○ |
| | 9 | F | 1 | 8.6 | 3.2 | 380 | 188 | 36 | 13680 | 10.8 | ○ | ○ |
| | 10 | G | 1 | 8.8 | 4.0 | 380 | 190 | 36 | 13300 | 10.6 | ○ | ○ |
| | 11 | H | 1 | 8.8 | 3.5 | 385 | 201 | 34 | 13090 | 10.6 | ○ | ○ |
| | 12 | I | 1 | 9.0 | 3.9 | 387 | 186 | 34 | 13158 | 10.6 | ○ | ○ |
| Comparative example | 13 | B | 1 | 11.0 | 6.1 | 295 | 155 | 28 | 8260 | 9.5 | X | X |
| | 14 | B | 1 | 10.3 | 5.5 | 330 | 169 | 31 | 10230 | 9.8 | Δ | Δ |
| | 15 | B | 1 | 10.2 | 6.0 | 280 | 140 | 25 | 7000 | 9.4 | X | X |
| | 16 | B | 2 | 10.2 | 5.1 | 330 | 170 | 32 | 10560 | 9.9 | Δ | Δ |
| | 17 | B | 2 | 10.3 | 5.5 | 329 | 173 | 30 | 9870 | 9.8 | Δ | Δ |
| | 18 | B | 3 | 10.2 | 5.2 | 335 | 172 | 31 | 10385 | 9.7 | Δ | Δ |
| | 19 | J | 1 | 4.1 | 0.8 | 330 | 175 | 28 | 9240 | 9.8 | X | X |
| | 20 | K | 1 | 10.3 | 2.0 | 336 | 178 | 31 | 10416 | 10.2 | Δ | Δ |
| | 21 | L | 1 | 10.9 | 1.9 | 335 | 177 | 31 | 10385 | 9.9 | Δ | Δ |
| | 22 | M | 1 | 9.5 | 5.1 | 330 | 175 | 31 | 10230 | 10.0 | Δ | Δ |

INDUSTRIAL APPLICABILITY

As explained above, an Al—Mg series alloy sheet of high-Mg with improved press formability which is applicable to automobile outer panels and inner panels can be provided by the present invention. This expands the applicability of Al—Mg series aluminum alloy continuous cast sheets to press forming uses, including automobile panels.

The invention claimed is:

1. An aluminum alloy sheet, which is an Al—Mg series aluminum alloy sheet with a thickness of 0.5 to 3 mm cast by twin-roll continuous casting and cold rolled, comprising over 8 and not more than 14 mass % Mg, 1.0 mass % or less Fe, and 0.5 mass % or less Si, wherein the mean conductivity of the aluminum alloy sheet is in the range of at least 20 IACS % but less than 26 IACS %, and the strength-ductility balance (tensile strength×total elongation) as a material property of the aluminum alloy sheet is 14175 (MPa %) or more.

2. The aluminum alloy sheet according to claim 1, wherein said aluminum alloy sheet further comprises at least one of 0.3 mass % or less Mn, 0.3 mass % or less Cr, 0.3 mass % or less Zr, 0.3 mass % or less V, 0.1 mass % or less Ti, 1.0 mass % or less Cu, and 1.0 mass % or less Zn.

3. The aluminum alloy sheet according to claim 1, wherein said strength-ductility balance is 14220 (MPa %) or more.

4. The aluminum alloy sheet according to claim 1, wherein said aluminum alloy sheet is manufactured by injecting a melt comprising over 8 and not more than 14 mass % Mg, 1.0 mass % or less Fe, and 0.5 mass % or less Si, with the remainder being Al and unavoidable impurities, into a pair of rotating twin rolls, and continuously casting to a sheet thickness in the range of 1 to 13 mm with the cooling rate of the twin rolls being 100° C./s or more.

5. The aluminum alloy sheet according to claim 1, wherein said aluminum alloy sheet is cast without the use of a lubricant on the surfaces of said twin rolls.

6. A method for manufacturing an aluminum alloy thin sheet with a thickness of 0.5 to 3 mm, the method comprising obtaining by twin-roll continuous casting an aluminum alloy sheet ingot having a thickness of 1 to 13 mm and comprising over 8 and not more than 14 mass % Mg, 1.0 mass % or less Fe, and 0.5 mass % or less Si;

cold rolling the ingot; and producing the aluminum alloy thin sheet, wherein the mean cooling rate for casting is 50° C./s or more between injection into the twin rolls and solidification of the center of the sheet ingot, while in subsequent processes the mean temperature-rising rate is 5° C./s or more when the temperature of the center of the sheet ingot or thin sheet is in the range of 200° C. to 400° C. while the sheet ingot or thin sheet is being heated to a temperature of 400° C. or more, and the mean cooling rate down to a temperature of 200° C. is 5° C./s or more while the sheet ingot or thin sheet is being cooled from a high temperature over 200° C.; and the aluminum alloy thin sheet is the aluminum alloy sheet of claim 1.

7. The method according to claim 6, wherein cooling is at a mean cooling rate of 5° C./s or more until the temperature falls to 200° C. immediately after the casting of said sheet ingot.

8. The method according to claim 6, wherein the mean temperature-rising rate is 5° C. or more while the temperature of the ingot center is between 200° C. and 400° C. during homogenizing heat treatment at a temperature between 400° C. and the liquidus temperature before cold rolling of said sheet ingot, while the mean cooling rate is 5° C./s or more between the homogenizing heat treatment temperature and 100° C.

9. The method according to claim 6, wherein said sheet ingot is subjected to said cold rolling at a temperature of 300° C. or more after casting, and either the mean cooling rate of the sheet during cold rolling is set at 50° C./s or more, or the sheet is cooled at a mean cooling rate of 5° C./s or more after cold rolling.

10. The method according to claim 6, wherein the mean temperature-rising rate is 5° C./s or more when the temperature of the sheet center is in the range of 200° C. to 400° C. during final annealing at a temperature between 400° C. and the liquidus temperature after said cold rolling, while the mean cooling rate is 5° C./s or more within the temperature range between the final annealing temperature and 100° C.

11. The method according to claim 6, wherein, in said aluminum alloy sheet ingot, elements are restricted to 0.3 mass % or less Mn, 0.3 mass % or less Cr, 0.3 mass % or less Zr, 0.3 mass % or less V, 0.1 mass % or less Ti, 1.0 mass % or less Cu, and 1.0 mass % or less Zn.

12. A method according to claim 6, wherein said aluminum alloy sheet ingot is cast without the use of a lubricant on the surfaces of said twin rolls.

13. The aluminum alloy sheet according to claim 1, wherein a mean crystalline grain size on a surface of the aluminum alloy sheet is in a range of from 20 μm to 100 μm.

* * * * *

UNITED STATES PATENT AND TRADEMARK OFFICE

CERTIFICATE OF CORRECTION

PATENT NO. : 8,420,011 B2
APPLICATION NO. : 11/814124
DATED : April 16, 2013
INVENTOR(S) : Makoto Morishita et al.

It is certified that error appears in the above-identified patent and that said Letters Patent is hereby corrected as shown below:

In the Specification

Column 3, delete line 25 in its entirety and replace with the following:

--to high temperatures of 400°C or more or a heated sheet--

Column 3, delete line 67 in its entirety and replace with the following:

--mm with the cooling rate of twin rolls at 100°C/s or more.--

Column 4, delete line 23 in its entirety and replace with the following:

--for casting is 50°C/s or more between injection into the twin--

Column 4, delete line 26 in its entirety and replace with the following:

--5°C/s or more when the temperature of the center of the--

Column 4, delete line 28 in its entirety and replace with the following:

--200°C to 400°C while the sheet ingot or thin sheet is being--

Column 4, delete line 29 in its entirety and replace with the following:

--heated to a temperature of 400°C or more, and the mean--

Column 4, delete line 30 in its entirety and replace with the following:

--cooling rate down to a temperature of 200° C is 5°C/s or--

Column 4, delete line 34 in its entirety and replace with the following:

--ingot or thin sheet to a temperature of 400°C or more or--

Signed and Sealed this
Tenth Day of June, 2014

Michelle K. Lee

Michelle K. Lee
*Deputy Director of the United States Patent and Trademark Office*

Column 4, delete line 36 in its entirety and replace with the following:

--over 200°C constitutes a heat history process in which--

Column 4, delete line 40 in its entirety and replace with the following:

--perature range down to 200°C when the aforementioned--

Column 4, delete line 42 in its entirety and replace with the following:

--ing heat treatment between 400°C and the liquidus tempera- --

Column 4, delete line 44 in its entirety and replace with the following:

--sheet ingot when it's temperature is 300°C or more following--

Column 4, delete line 45 in its entirety and replace with the following:

--casting, and final annealing between 400°C and the liquids--

Column 5, delete line 12 in its entirety and replace with the following:

--rising rate is increased to 5°C/s or more and not reduced--

Column 5, delete line 14 in its entirety and replace with the following:

--plate is in the range of 200°C to 400°C while the plate ingot--

Column 5, delete line 15 in its entirety and replace with the following:

--or thin plate is being heated to a temperature of 400°C or--

Column 5, delete line 18 in its entirety and replace with the following:

--Moreover, the mean cooling temperature down to 200°C--

Column 5, delete line 19 in its entirety and replace with the following:

--is increased to 5°C/s or more and not reduced when the sheet--

Column 5, delete line 21 in its entirety and replace with the following:

--over 200°C in the aforementioned heat history processes--

Column 7, delete line 15 in its entirety and replace with the following:

--of more than 8% and no more than 14% Mg, 1.0% or less Fe--

Column 8, delete line 59 in its entirety and replace with the following:

--casting needs to be as fast as possible, 50°C/s or more. When--

Column 8, delete line 62 in its entirety and replace with the following:

--tical cooling rate is likely to be less than 50°C/s Conse- --

Column 9, delete line 12 in its entirety and replace with the following:

--arm spacing in mm and C is the cooling rate in °C/s ) so--

Column 9, delete line 34 in its entirety and replace with the following:

--+30 °C or less when the injection temperature exceeds the--

Column 9, delete line 35 in its entirety and replace with the following:

--liquidus temperature +30 °C, the casting cooling rate--

Column 9, delete line 65 in its entirety and replace with the following:

--final annealing at a temperature between 400° C and the--

Column 9, delete line 67 in its entirety and replace with the following:

--400°C, the solution effect is likely not to be achieved. This--

Column 10, delete line 2 in its entirety and replace with the following:

--rapid mean cooling rate of 5°C/s or more in the temperature--

Column 10, delete line 5 in its entirety and replace with the following:

--5°C/s, large amounts of overall intermetallic compounds--

Column 10, delete line 14 in its entirety and replace with the following:

--400°C or more or cooling the sheet ingot or thin sheet from--

Column 10, delete line 15 in its entirety and replace with the following:

--a high temperature above 200°C constitutes a heat history--

Column 10, delete line 34 in its entirety and replace with the following:

--range down to 200°C of the sheet ingot, AI-Mg series--

Column 10, delete line 37 in its entirety and replace with the following:

--the sheet ingot is cooled at a mean cooling rate of 5°C/s or--

Column 10, delete line 39 in its entirety and replace with the following:

--200°C in order to control the occurrence of AI-Mg series--

Column 10, delete line 45 in its entirety and replace with the following:

--rolling at temperatures between 400°C and the liquidus--

Column 10, delete line 52 in its entirety and replace with the following:

--at which the temperature of the ingot center is 200°C to 400°--

Column 10, delete line 54 in its entirety and replace with the following:

--enizing heat treatment temperature down to 100°C during--

Column 10, delete line 58 in its entirety and replace with the following:

--set at 5°C/s or more when the temperature of the ingot center--

Column 10, delete line 59 in its entirety and replace with the following:

--is within the range of 200°C to 400°C in order to control the--

Column 11, delete line 3 in its entirety and replace with the following:

--for cold rolling (or warm rolling) is 300° C or more, AI-Mg--

Column 11, delete line 7 in its entirety and replace with the following:

--temperature of 300° C or more is selectively cold rolled (or--

Column 11, delete line 10 in its entirety and replace with the following:

--C/s or more, or the sheet is cooled at a mean cooling rate of--

Column 11, delete line 11 in its entirety and replace with the following:

--5° C/s or more after cold rolling (or after warm rolling).--

Column 11, delete line 14 in its entirety and replace with the following:

--solution treatment) after cold rolling at between 400° C and--

Column 11, delete line 22 in its entirety and replace with the following:

--temperature of the sheet center is 200° C to 400° C as the--

Column 11, delete line 24 in its entirety and replace with the following:

--range from the final annealing temperature down to 100° C--

Column 11, delete line 27 in its entirety and replace with the following:

--treatment, the mean temperature-rising rate is set at 5° C/s or--

Column 11, delete line 30 in its entirety and replace with the following:

--center is within the range of 200° C to 400° C while heating--

Column 11, delete line 33 in its entirety and replace with the following:

--set at 5° C/s or more in the range between the final annealing--

Column 11, delete line 33 in its entirety and replace with the following:

--set at 5° C/s or more in the range between the final annealing--

Column 11, delete line 46 in its entirety and replace with the following:

--at between 400° C and the liquidus temperature. If the--

Column 11, delete line 47 in its entirety and replace with the following:

--annealing temperature is below 400° C the solution effect is--

Column 11, delete line 50 in its entirety and replace with the following:

--In normal cold rolling in which the Al alloy sheet ingot is--

Column 11, delete line 63 in its entirety and replace with the following:

--annealing is at a temperature of 400° C or more the condi- --

Column 12, delete line 16 in its entirety and replace with the following:

--direction of length (L) of a sheet. This crystalline grain size--

Column 12, delete line 41 in its entirety and replace with the following:

--liquidus temperature +20° C for all examples. Lubrication of--

Column 14, delete line 6 in its entirety and replace with the following:

--lubricated at a cooling rate of less than 100° C/s As a results--

Column 19, delete line 15 in its entirety and replace with the following:

--cooling rate of 50° C/s or more between injection into the--

Column 19, delete line 18 in its entirety and replace with the following:

--cesses the mean temperature-rising rate was 5° C/s or more--

Column 19, delete line 20 in its entirety and replace with the following:

--sheet ingot or thin sheet was between 200° C and 400° C--

Column 19, delete lines 22-23 in their entirety and replace with the following:

--to a temperature above 400° C, and the mean cooling rate was 5° C/s or more down to a temperature of 200°C during cooling of--

Column 19, delete line 37 in its entirety and replace with the following:

--cooling rate for casting was too low, less than 50° C/s As a--

Column 22, delete line 7 in its entirety and replace with the following:

--300° C or more →final annealing--

In the Claims

Column 23, delete line 64 in its entirety and replace with the following:

--being 100°C or more.--

Column 24, delete line 37 in its entirety and replace with the following:

--the mean cooling rate for casting is 50°C/s or more--

Column 24, delete line 40 in its entirety and replace with the following:

--cesses the mean temperature-rising rate is 5°C/s or--

Column 24, delete line 42 in its entirety and replace with the following:

--ingot or thin sheet is in the range of 200°C to 400°C--

Column 24, delete line 44 in its entirety and replace with the following:

--temperature of 400°C or more, and the mean cooling--

Column 24, delete line 45 in its entirety and replace with the following:

--rate down to a temperature of 200°C is 5°C/s or more--

Column 24, delete line 47 in its entirety and replace with the following:

--high temperature over 200°C; and--

Column 24, delete line 51 in its entirety and replace with the following:

--a mean cooling rate of 5°C/s or more until the temperature--

Column 24, delete line 52 in its entirety and replace with the following:

--falls to 200°C immediately after the casting of said sheet--

Column 24, delete lines 54-61 in their entirety and replace with the following:

--8. The method according to claim 6, wherein the mean temperature-rising rate is 5°C or more while the temperature of the ingot center is between 200°C and 400°C during homogenizing heat treatment at a temperature between 400°C and the liquidus temperature before cold rolling of said sheet ingot, while the mean cooling rate is 5°C/s or more between the homogenizing heat treatment temperature and 100°C.--

Column 24, delete lines 62-67 in their entirety and replace with the following:

--9. The method according to claim 6, wherein said sheet ingot is subjected to said cold rolling at a temperature of 300°C or more after casting, and either the mean cooling rate of the sheet during cold rolling is set at 50°C/s or more, or the sheet is cooled at a mean cooling rate of 5°C/s or more after cold rolling.--

Column 25, delete lines 1-7 in their entirety and replace with the following:

--10. The method according to claim 6, wherein the mean temperature-rising rate is 5°C/s or more when the temperature of the sheet center is in the range of 200°C to 400°C during final annealing at a temperature between 400°C and the liquidus temperature after said cold rolling, while the mean cooling rate is 5°C/s or more within the temperature range between the final annealing temperature and 100°C.--

UNITED STATES PATENT AND TRADEMARK OFFICE

CERTIFICATE OF CORRECTION

PATENT NO. : 8,420,011 B2
APPLICATION NO. : 11/814124
DATED : April 16, 2013
INVENTOR(S) : Morishita et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1315 days.

Signed and Sealed this
Sixteenth Day of December, 2014

Michelle K. Lee

Michelle K. Lee
*Deputy Director of the United States Patent and Trademark Office*